United States Patent [19]

Dassler

[11] Patent Number: 4,616,431

[45] Date of Patent: Oct. 14, 1986

[54] SPORT SHOE SOLE, ESPECIALLY FOR RUNNING

[75] Inventor: Armin A. Dassler, Herzogenaurach, Fed. Rep. of Germany

[73] Assignee: Puma-Sportschunfabriken Rudolf Dassler KG, Fed. Rep. of Germany

[21] Appl. No.: 664,434

[22] Filed: Oct. 24, 1984

[30] Foreign Application Priority Data

Oct. 24, 1983 [DE] Fed. Rep. of Germany ..... 3338556

[51] Int. Cl.[4] ..... A43B 13/18

[52] U.S. Cl. ..... 36/28; 36/30 R

[58] Field of Search ..... 36/27, 28, 30 R, 30 A, 36/114, 35 R, 37, 103

[56] References Cited

U.S. PATENT DOCUMENTS

| | | | |
|---|---|---|---|
| 2,437,227 | 3/1948 | Hall | 36/30 R X |
| 2,721,400 | 10/1955 | Israel | 36/28 X |
| 2,885,797 | 5/1959 | Chrencik | 36/28 X |
| 4,364,188 | 12/1982 | Turner et al. | 36/129 X |

FOREIGN PATENT DOCUMENTS

| | | | |
|---|---|---|---|
| 944890 | 11/1948 | France | 36/28 |
| 1485654 | 1/1965 | German Democratic Rep. | 36/28 |

*Primary Examiner*—Werner H. Schroeder
*Assistant Examiner*—T. Graveline
*Attorney, Agent, or Firm*—Sixbey, Friedman & Leedom

[57] ABSTRACT

A sole for a sport shoe, especially of the type used for running over great distances, and having a one or multi-layered midsole made of soft, elastic, shock-absorbing material disposed between an insole and an outer sole of abrasion resistent material, the midsole being provided with vertically oriented damping members possessing harder resiliency characteristics than the material of the midsole. For the purpose of improving the mounting of the damping members and for enlarging the degree to which the damping characteristics can be adjusted, the damping members are formed as damping discs (6) that are exchangeably insertable in cylinders (5). A piston (8) is received in each cylinder for pressing against the damping discs (6).

20 Claims, 2 Drawing Figures

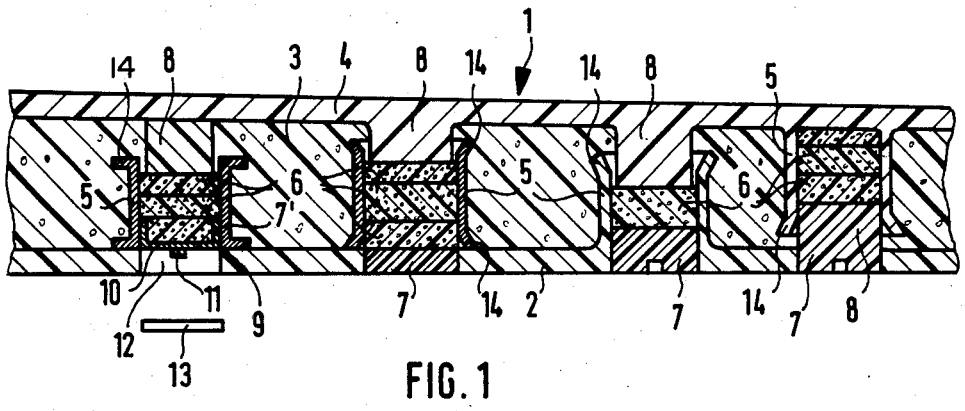
FIG. 1
FIG. 2
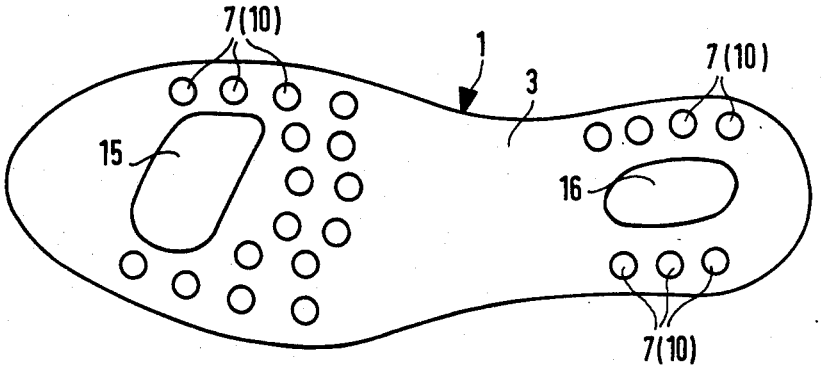

SPORT SHOE SOLE, ESPECIALLY FOR RUNNING

BACKGROUND AND SUMMARY OF THE INVENTION

The present invention relates to a sport shoe sole, especially of the type used for running shoes, particularly for long distance running, and having a midsole of shock absorbing material disposed between an insole and an outer sole of wear resistant material, the midsole being provided with inserts for increasing the hardness characteristics thereof.

A running shoe with such a sole has been known from the U.S. Pat. No. 4,364,188. There, for a good damping of the high pressure and shock loads occurring especially in the area of the ball and in the area of the heel, in both these areas, always one island-shaped cushion is provided in the soft midsole, which is even softer than the remaining part of the midsole. For the purpose of controlling the damping and for the stabilization of the running characteristics in the heel area, there, adjoining the island-shaped cushion toward the inner (medial) side of the running shoe, several cylindrical plugs made of an elastic material that is harder than that of the midsole are inserted into the midsole. In order to be able to adapt the shoe to the specific requirements of the particular runner, plugs of variable hardness may be plugged into the bores of the midsole from the direction of the outer sole. Several such plugs may be molded onto a carrier and may be inserted jointly into the intermediate sole, whereby, after insertion, the carrier joins in forming a part of the outer sole.

The present invention has a principal object of improving a running shoe of the initially mentioned type with regard to the manner of fixing of the damping members in the sole, and enlargement of the area in which they are locatable as well as the degree of adjustability of their damping characteristics.

This object is achieved, in accordance with a preferred embodiment of the invention, by constructing the damping members as a plurality of exchangeable damping discs that are received in a cylinder and acted upon by a piston. As a result of the cylinder-piston-principal used, one will obtain a better fixation of the damping elements relative to lateral deflection in the soft midsole and, in addition, several damping discs of variable hardness or compressibility may be mounted one on top of the other, and, thus, almost any given damping or resiliency characteristic may be achieved.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 1 shows a section of a multilayered sole of a sport shoe according to the invention; and FIG. 2 shows a bottom view of a midsole of such a sport shoe.

DETAILED DESCRIPTION OF THE PREFERRED EMBODIMENT

The numeral 1 generally designates a sole of a sport shoe especially for running, preferably for long distance running. The sole 1 comprises the outer sole 2, which is made of abrasion resistant material since it is the ground contacting layer of the sole; a midsole 3, which is made of a soft elastic, especially, highly porous material, such as foamed polyurethane, with a specific weight of 0.02 to 0.04 g/cm$^3$; and an upper layer 4 (or a correspondingly formed insole layer) which is also made of harder, elastic material, in this case, for example leather, a compressed substance or fiber substance or comparable synthetic material. The individual parts of the sole are interconnected for example either by foaming or by adhesion. The outer sole 2 may have cleats or variable profiles provided on its ground engaging surface, the nature of which would depend upon the particular use as is known per se.

According to the invention and for the purpose of adjusting the damping characteristic or the resiliency characteristic of the entire sole, vertically standing cylinders 5, 5', 5'', 5''' are provided in the midsole 3. Into these cylinders, preferably from the direction of the outer sole 2, one or more damping discs 6, made of the same material or of materials with different damping characteristics, may be inserted. In each case, a piston 8, 8', 8'', 8''' extends into a respective cylinder 5, 5', 5'', 5''', respectively, which piston presses against the damping discs 6, at least during running, i.e., under loading conditions.

In the case of the embodiment shown by way of example, the cylinder-piston units are each constructed in a different manner, but it should be recognized that, normally, only one form would be used in any given sole. For example, they could all be attached to the insole, or an upper layer of sole 1, 4 (left-most piston FIG. 1), or they could be unitarily formed therewith, for example, as an injection molded plastic part (center two pistons, FIG. 1). At the same time, the cylinders 5, 5', 5'' may be supported on the inside of the outer sole 2 with or without being attached thereto, for example, by adhesion or by locking formations and/or by riveting or some similar means (left two cylinders 5, 5'); however, the cylinders preferably, are unitarily formed as part of the outer sole 2 (right-center cylinder 5'', FIG. 1). Also, the cylinders may be attached by the upper sole layer or insole 4, the pistons 8''', then, being located at the outer sole 2 or being held by the midsole 3 in any of the noted manners. In the latter case, the closing part 7''' may, at the same time, be enlarged to also serve as a piston (right-most piston, FIG. 1). In the two examples on the right in FIG. 1, the closing part, 7'', 7''' may be screwed in or inserted into the outer sole 2 and/or secured by gluing and still extend into the cylinder 5 or 5'.

Between the insole, or upper layer of the sole 1, 4 and the midsole 3 or following the insole 4 toward the inside of the shoe, an inside sole of hard, elastic material may still be provided, and the former may then carry the pistons 8, 8', 8'' or the cylinders 5''' or may form a construction unit with the latter. Basically, it is also possible to develop the midsole 3 from several layers of an equal or a varying degree of foaming and corresponding damping characteristics.

The left-most example of FIG. 1 shows a pot-or hood-shaped closing part 7 of U-shaped cross section which may be screwed through outer sole 2 into cylinder 5 by means of a flange 9. The bottom 10 of the pot-shape is provided with an engagement element 11, for example, a strip or a slit or inside polyhedral or something similar, for rotation thereof. As a result of the possibility of such a screwing in of the closing part 7, it will be possible, additionally, and depending upon the depth of screwing in, to achieve a fine adjustment of the damping or spring characteristic. Preferably, the remaining portion of the opening 12 in the outer sole 2 may be closed, for example, with a lid 13 which may be forced in or constructed to spread outwardly after insertion, especially one made from aluminum sheet, plastic, or the like.

Effectively, the cylinders, at least on the piston receiving side, may be widened at their free edge 14, 14', 14'', 14'''. When cylinders are formed as separated parts, as in the left two examples 5, 5', it is advantageous to simply provide such a shaping at both ends. The widened edge 14, 14' anchors the cylinders relative to the midsole and a funnel-shape widening facilitates reception of the pistons, guiding a slightly off-center piston into the cylinder. The arrangement of the cylinders 5 with the damping discs 6 and the pistons 8, 8', 8'', 8''' may be distributed over the entire sole 1. Preferably, however, they are provided in a pattern, as shown in FIG. 2, around the areas experiencing heaviest loading during running, namely in the area of the ball 15 and, especially, in the area of the heel 16. In the case of the heel area 16, damping units are disposed, preferably, at both sides and, in the area 15 of the ball, at both sides and to the rear. As a result, the stresses from shock in these areas will be decreased by the damping units due to the fact that they are distributed over a greater pressure area with an intended adjustable damping characteristic.

The cylinders 5, 5', 5'', 5''' and the pistons 8, 8', 8'', 8''' are developed such that the cylinders 5, 5', 5'', 5''' span at least 40% to a maximum of 80% of the thickness of the midsole 3, whereby the pistons 8 may engage within cylinders 5 to an extent of at least 5% to a maximum of 90% of the length of the cylinders 5, 5', 5'', 5'''. As a result, it will be ensured that the pistons 8 engage sufficiently with the cylinders 5 and are guided in the latter. On the other hand, the cylinders 5, 5', 5'', 5''' are also supported to a sufficient measure in the midsole 3 against lateral deflection, even if they are not attached to the running sole 2 or at the insole 4 or an inside sole present between the insole 4 and the middle sole 3.

As has already been indicated, one or more damping discs 6 may be accommodated in the individual cylinders 5, 5', 5'', 5'''. In the case of the use of several damping discs 6 per cylinder-piston unit (e.g., 5, 8), it will also be possible to use damping discs 6 with varying damping and resiliency characteristics in order to be able to adjust them to achieve optimal damping depending on the type of the load. The damping discs 6 consist, preferably, of an elastically resilient, volume-compressible material such as foamed plastic of respective higher and lower degrees of foaming.

Especially in the case of the arrangement of the pistons 8''' on the running sole 2 and the mounting of the cylinders 5, 5' in the intermediate sole 3, an equipping of the cylinder-piston units with damping discs 6 on the side of the insole is also possible. In that case, the upper layer of the sole 1 or insole, 4, and/or the inside sole is developed as a removable sole layer, for example, by way of a burr closure connection (e.g., as sold under the VELCRO trademark).

Basically, the arrangement of the cylinder-piston units (e.g., 5, 8) may also be made in such a way that they surround the "soft" ball and heel areas 15, 16 completely, coaxially in one or more rows. It is also possible to provide damping characteristics on the outside of the sole that are different from those characteristics on the inside of the sole.

While I have shown and described a single embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. Sport shoe sole, especially for running shoes of the type having a midsole of shock absorbing material, disposed between an insole made of soft elastic material and an outer sole made of abrasion resistant material, that is provided with vertically oriented damping members therein of harder resiliency characteristics than those of the material of the midsole, wherein the damping members comprise exchangeably insertable damping discs in cylinders and pistons for pressing against the damping discs, each piston being received within a respective cylinder and wherein an opening is associated with each cylinder of a size corresponding to the size of the damping discs for enabling exchange and insertion of said damping discs therethrough.

2. Sport shoe sole as in claim 1, wherein the cylinders are accessible through openings in the outer sole and said openings in the outer sole and the cylinders are closed by closing parts.

3. Sport shoe sole as in claim 2, wherein the closing parts are screwed into at least one of the running sole and the cylinders.

4. Sport shoe sole as in claim 3, wherein the closing parts are recessed into the outer sole and recesses formed thereby in the outer sole are closed by lids.

5. Sport shoe sole as in claim 2, wherein at least one of the closing parts forms a respective one of said pistons.

6. Sport shoe sole as in claim 1, wherein the pistons are attached to one of the insole and an upper layer of the shoe sole, and the cylinders are disposed in the midsole.

7. Sport shoe sole according to claim 6, wherein the pistons are attached to said one of the insole and upper layer in a unitary manner.

8. Sport shoe sole as in claim 6, wherein the cylinders are attached on the outer sole.

9. Sport shoe sole according to claim 8, wherein the cylinders are attached to the running sole in a unitary manner.

10. Sport shoe sole according to claim 1, wherein the cylinders are attached to one of the insole and an upper layer of the shoe sole so as to extend into the midsole, and the pistons are attached to the outer sole.

11. A sport shoe sole according to claim 10, wherein the cylinders are attached to said one of the insole and upper layer in a unitary manner.

12. Sport shoe sole as in claim 1, wherein the cylinders span at least 40% and a maximum of 80% of the thickness of the midsole and the pistons engage within said cylinders to an extent of at least 5% to a maximum of 90% of the length of the cylinders.

13. Sport shoe sole as in claim 1, wherein at least one of the free ends of the cylinders is provided with a widening.

14. A sport shoe sole according to claim 13, wherein the widening of the free ends is funnel-shaped, and is provided at least at the ends of the cylinders through which said pistons are received.

15. Sport shoe sole as in claim 1, wherein the damping members are provided in a heel part of the shoe sole in which the highest pressure loads, in use, occur, at least on both sides of the heel area.

16. Sport shoe sole as in claim 15, wherein the damping members are provided in an area of the ball of the shoe sole in which the highest pressure loads, in use, occur, at least at both sides and to the rear of the ball area.

17. Sport shoe sole as in claim 1, wherein the damping members are provided in an area of the ball of the shoe sole in which the highest pressure loads, in use, occur, at least at both sides and to the rear of the ball area.

18. Sport shoe sole as in claim 1, wherein a plurality of damping discs are provided in respective cylinders.

19. Sport shoe sole as in claim 18, wherein the plurality of damping discs of the respective cylinders comprises discs of different characteristics.

20. Sport shoe sole as in claim 1, wherein the damping discs consist of elastically resilient, volume-compressible material.

* * * * *